United States Patent [19]

McGregor, Jr.

[11] Patent Number: 4,674,314

[45] Date of Patent: Jun. 23, 1987

[54] METHOD AND APPARATUS FOR SINGLE STEP FORMATION OF SPHERICAL RETAINER

[76] Inventor: John C. McGregor, Jr., c/o Pentaflex, Inc., P.O. Box 1566, Springfield, Ohio 45501

[21] Appl. No.: 854,971

[22] Filed: Apr. 23, 1986

Related U.S. Application Data

[62] Division of Ser. No. 706,997, Feb. 28, 1985, Pat. No. 4,604,886.

[51] Int. Cl.[4] ..... B21K 1/05

[52] U.S. Cl. ..... 72/354; 72/414; 29/148.4 C

[58] Field of Search ..... 29/148.4 R, 148.4 C, 29/149.5 DP; 72/325, 354, 360, 412, 414, 416

[56] References Cited

U.S. PATENT DOCUMENTS

| | | | |
|---|---|---|---|
| 2,169,228 | 8/1939 | Debor | 72/360 |
| 2,276,684 | 3/1942 | Bellg | 72/354 |
| 3,080,839 | 3/1963 | Fein et al. | 72/354 |
| 4,369,558 | 1/1983 | Iwata et al. | 29/148.4 R |

FOREIGN PATENT DOCUMENTS

| | | | |
|---|---|---|---|
| 165231 | 12/1980 | Japan | 72/325 |

*Primary Examiner*—Lowell A. Larson

*Attorney, Agent, or Firm*—Biebel, French & Nauman

[57] ABSTRACT

A tool for stamping annular blanks to form retainers for truncated spherical members in a single stroke stamping operation comprises a sectored punch having at least one pair of diametrically opposed sectors of a cyclinder separated from one another at their apexes such that the sectors of two punches can be intermated. The distal ends of the sectors are spherically contoured such that alternating spherical surfaces are formed on the inside surface of the retainers by two intermating sectored punches. The sectored punches form alternating cylindrical and spherical surfaces into the upper and lower portions of a blank to form the retainer. The cylindrical surfaces permit spherical members to be inserted into the retainers by hand or with the use of hand tools.

9 Claims, 13 Drawing Figures

METHOD AND APPARATUS FOR SINGLE STEP FORMATION OF SPHERICAL RETAINER

This is a division of application Ser. No. 706,997 filed Feb. 28, 1985 now U.S. Pat. No. 4,604,886 granted Aug. 12, 1986.

BACKGROUND OF THE INVENTION

The present invention relates generally to a spherical retainer and, more particularly, to a method and apparatus for forming a spherical retainer in a single stroke stamping operation.

Spherical retainers used, for example, in self-aligning bearings and rod end bearings have been formed in the prior art in a single stamping operation. In the prior art, a truncated spherical bearing is initially inserted into a generally cylindrical member or sleeve with the combination bearing and sleeve being subjected to a stamping operation which conforms the sleeve to the bearing. Such formation typically seizes the truncated spherical bearings within the sleeves as they are stamped to form spherical retainers. In U.S. Pat. No. 2,724,172, the spherical retainer or outer race member is subsequently subjected to a rolling force to free the retainer from the bearing.

In U.S. Pat. No. 2,728,975, a single step stamping operation is also performed to form a retainer about a truncated spherical bearing inserted therein. To free the retainer from the bearing in the disclosed process, the bearing is initially heated above room temperature prior to the formation of the retainer.

In U.S. Pat. No. 2,892,246, a self-aligning bearing is formed in a single stamping operation wherein a truncated spherical bearing is initially inserted into a generally cylindrical member which is then stamped around the bearing to form a retainer. In the disclosed process, relative movement of stamping dies is stopped at a predetermined point by abutment of a die with a post positioned within the truncated spherical bearing such that the bearing is not seized by formation of the retainer.

Similarly, U.S. Pat. No. 4,207,659 is directed to a method for forming a bearing housing in which a semi-finished housing is assembled with the bearing and the outside of the semi-finished housing is pressed inwardly to conform the inside surface of the housing to the outside surface of the bearing on a machine press. In the disclosed process, limited force is exerted such that the bearing is not seized by formation of the housing or retainer.

More recently, retainers for truncated spherical members have been formed separate from the spherical members to permit later assembly by hand or the use of hand tools. U.S. Pat. No. 4,428,688 to John C. McGregor, Jr., the inventor herein, is directed to a spherical retainer and is hereby incorporated by reference. The McGregor retainer is constructed from a planar support member having an opening therein by outwardly bending alternating pairs of diametrically opposed lip members to opposite sides of the support member. The lip members are positioned and dimensioned such that a truncated spherical member can be inserted into the retainer opening with its center axis oriented perpendicular to the center axis of the retainer opening and rotated about an equatorial axis by hand or with a hand tool into a position in which its center axis is common with the center axis of the retainer opening.

In this position, the spherical member is locked against relative axial movement by the lip members.

The McGregor retainer previously has been formed in a two step stamping operation wherein the planar support member is initially inserted into a pair of dies which forms the lip members extending to one side of the support member. The support member is then flipped and rotated such that the same pair of dies is used to form the lip members extending to the opposite side of the planar support member. While the McGregor retainer is advantageous for its simple economical unitary construction and because it permits hand or hand tool assembly, the second step of the two step process used to form the retainer tends to deform the first stamped lip members reducing the tolerances which may be achieved.

Accordingly, a spherical retainer which has all the advantages of the McGregor retainer and at the same time may be formed in a single stamping operation would be desirable for use in those applications in which closer tolerances are desirable or required.

SUMMARY OF THE INVENTION

The present invention provides a method and apparatus for forming spherical retainers in a single stroke stamping operation with the retainers being formed to later receive truncated spherical members by means of hand assembly or by the use of hand tools. The apparatus in its simplest form comprises a sectored punch having at least one pair of diametrically opposed sectors of a cylinder separated from one another at their apexes such that the sectors of a second sectored punch can be intermated with those of the first punch to form a cylinder. The distal ends of the sectors are spherically contoured such that alternating spherical surfaces are formed on the inside surface of spherical retainers by stamping annular blanks between two intermating sectored punches. Preferably the total number of sectors on a punch occupy slightly less than half of the cylinder formed by intermated sectors of two punches such that two substantially identical punches can be used with one another.

Alternating cylindrical and spherical surfaces are formed into the upper and lower portions of a blank to form a spherical retainer. A cylindrical surface on the upper portion of a retainer is opposite to a spherical surface on the lower portion of the retainer, and a spherical surface on the upper portion of the retainer is opposite to a cylindrical surface on the lower portion of the retainer, with each axially opposed cylindrical and spherical surface being formed on opposite sides of a blank by a sector of one of the two sectored punches.

A spherical retainer formed by the method and apparatus of the present invention is designed to be assembled with a truncated spherical member, such as a bearing, by hand or by using hand tools, by inserting a bearing into two diametrically opposed cylindrical surfaces on either side of the retainer with the bearing center axis oriented perpendicular to the center axis of the retainer and rotating the bearing about an axis on its equator such that the center axis of the bearing and the retainer become coaxial. In this position, the spherical surfaces on the upper and lower portions of the retainer contact the spherical surface of the retained spherical member to prevent relative axial and radial movement between the bearing and the retainer. At the same time, the member can pivot about its axis within the retainer giving it a self-aligning capability.

In accordance with one embodiment of the present invention, the apparatus for forming a spherical retainer further comprises a substantially planar die from which the punch extends and impinging segments extending above the surface of the die and positioned outside the cylinder formed by the intermated punches and between the sectors of the punch. Preferably, the impinging segments are arcuate and extend substantially the entire distance between adjacent sectors of a punch. Alternately, impinging segments extending from and integral with the floor of the die are used. Here again, the impinging segments are preferably arcuate and extend substantially the entire distance between adjacent sectors of a punch.

In accordance with another embodiment of the invention, the apparatus may further comprise an inwardly tapering frustum die surrounding the punch. In this embodiment, the annular blank is planar, formed, for example, of metal plate, and has a plurality of slots or notches extending generally radially outwardly from a central opening to form a plurality of retainer lips. The frustum die cooperates with the spherical contours of the distal ends of the punch sectors to form the retainer lips into alternating spherical member engaging lips. In embodiment, a McGregor TM® retainer is formed in a single stamping operation.

To help align a pair of punches which are being used to form a spherical retainer in a single stroke stamping operation in accordance with the present invention, it may be desirable to form the apex separation between sector pairs as a machined cylindrical bore for slidingly receiving an alignment pin. One or more sector pairs are contemplated for the punch in accordance with the present invention. As the number of sector pairs is increased, the size of the sectors is reduced and, hence, the strength of the sectors is also reduced. When the number of sector pairs is increased, the alignment pin also serves to stabilize and strengthen the sectors of the punches.

A method of forming a retainer for a truncated spherical member in a single stroke stamping operation in accordance with the present invention comprises the steps of:

inserting an annular blank between substantially identical upper and lower tools, each comprising a die, a sectored punch and impinging segments as described above; and, compressing the annular blank between the upper and lower tools to form alternating cylindrical and spherical surfaces in the upper and lower portions of the blank with a cylindrical surface on the upper portion of the blank being formed opposite to a spherical surface on the lower portion of the blank and a spherical surface on the upper portion of the blank being formed opposite to a cylindrical surface on the lower portion of the blank.

Each sector of each punch of the upper and lower tools forms a spherical surface on one side of a retainer as a blank is stamped, with the axially opposite cylindrical surface either also being formed by the punch sector or remaining intact as the cylindrical surface originally present within the blank. A further step contemplated in accordance with this method of the present invention comprises inserting a pin into the center of the sectored punch of one of the upper and lower tools to thereby align the upper and lower tools and provide support for the sectors of the punches.

Another method of forming a retainer for a truncated spherical member in a single stroke stamping operation in accordance with the present invention comprises the steps of: inserting a planar annular blank between substantially identical upper and lower tools, each comprising a frustum die tapered inwardly to a planar floor and a sectored punch extending outwardly within the die from the floor; and, compressing the annular blank between the upper and lower tools to form alternating spherical member enveloping lips equal in number to the number of sectors on the punches of the two tools and extending alternately out opposite sides of the blank.

Each spherical member engaging lip being formed by a sector of the punch of one of the upper or lower tools. A further step contemplated in accordance with this method of the present invention comprises inserting a pin into the center of one of the sectored punches of the upper and lower tools to thereby align the upper and lower tools and provide support for the sectors of the punches.

A further embodiment of the present invention is a retainer for truncated spherical members formed in accordance with the present invention.

It is, therefore, an object of the present invention to provide an improved method and apparatus for forming a retainer for a truncated spherical member in a single stamping operation.

Other objects and advantages of the invention will be apparent from the following description, the accompanying drawings and the appended claims.

DETAILED DESCRIPTION OF THE INVENTION

Figure 1A:
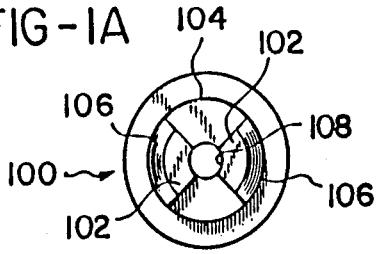
FIGS. 1A–1C are the top, side and front views, respectively, of a sectored punch in accordance with the present invention.
Figure 1B:
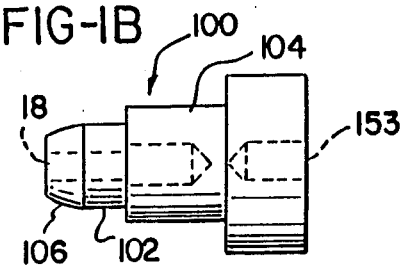
Figure 1C:
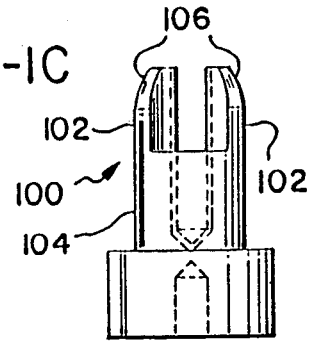
Figure 2:
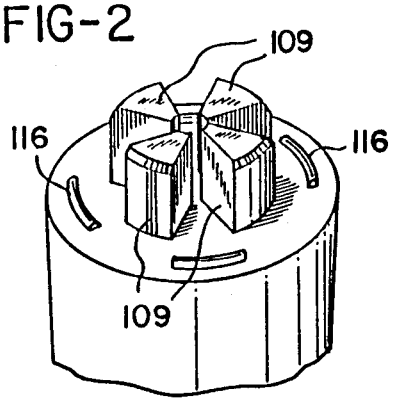
FIG. 2 is a perspective view of a sectored punch having two pairs of sectors.

FIGS. 1A–1C illustrate one example of a sectored punch 100 of the present invention which is utilized to form a spherical retainer in a single stamping operation. The punch 100 of FIGS. 1A–1C comprises one pair of diametrically opposed sectors 102 of a cylinder 104, with the sectors 102 in this embodiment occupying slightly less than half of the cylinder 104. The sectors 102 are separated from one another at their apexes such that the sectors of a substantially identical sectored punch can be intermated therewith as best shown in FIG. 2 with the intermated punch sectors forming a substantially cylindrical body.

In other embodiments of the invention, the sectors on punch 100 may occupy greater than or less than half of the cylinder 104. These embodiments are also advantageous but the intermating punches are not identical and tooling costs may therefore be higher.

Figure 7:
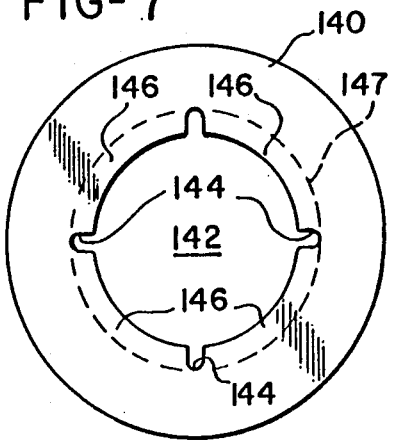
FIG. 7 is a substantially planar annular blank.
Figure 8:
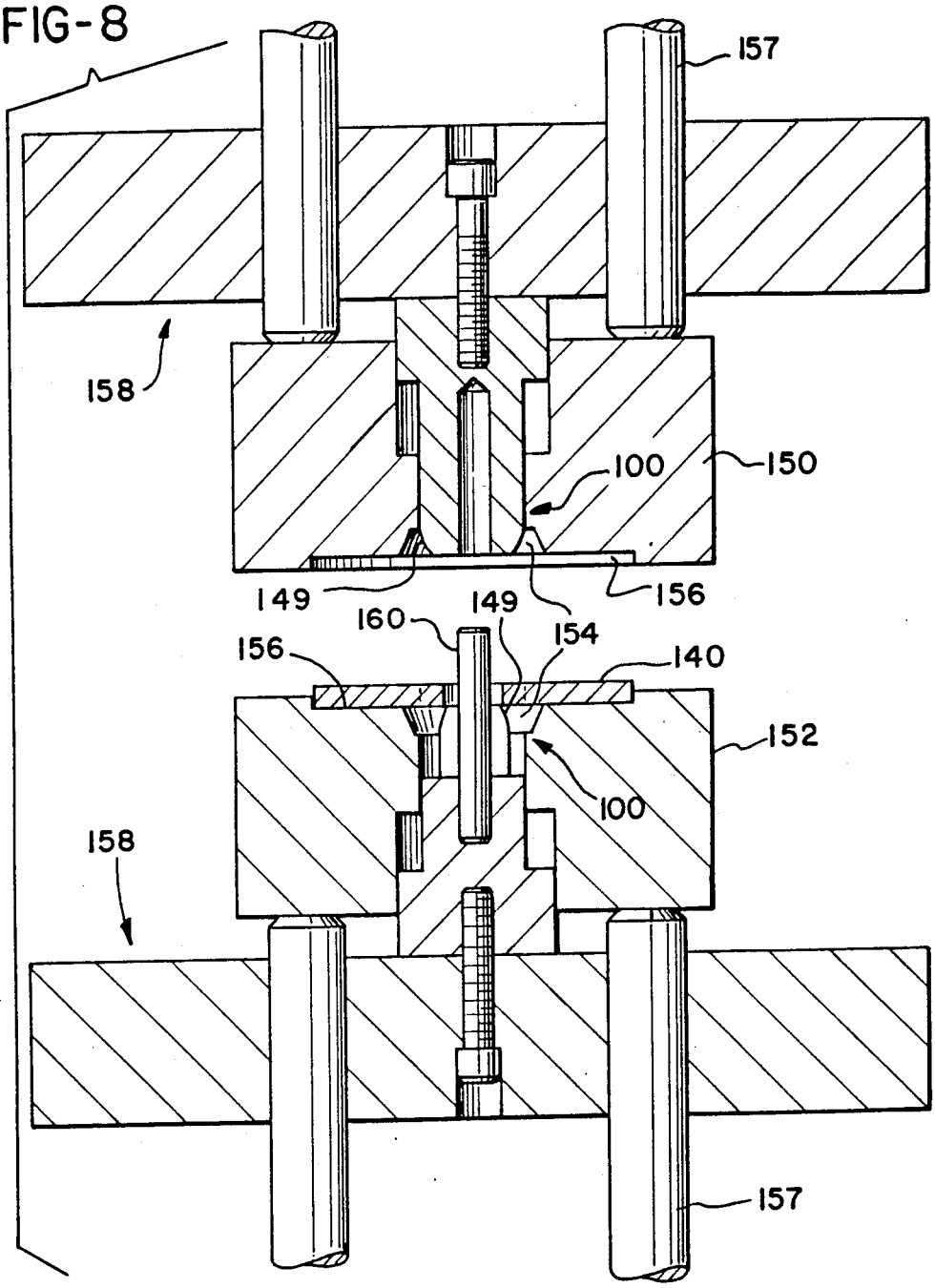
FIGS. 8 and 9 illustrate the formation of a McGregor retainer from the blank of FIG. 7 in a single stamping operation.

The distal ends 106 of the sectors 102 of the punch 100 are spherically contoured such that a spherical retainer is formed by stamping an annular blank between two sectored punches 100 which are intermated face-to-face to engage the blank. As illustrated in FIGS. 1A–1C, the separation of the sectors 102 of the punch 100 comprises a machined bore 108 for receiving a pin for aligning two of the punches 100 as they are intermated and also for strengthening and stabilizing the sectors 102 of the sectored punch 100 as will become apparent and as shown in FIGS. 7 and 8.

As illustrated in FIGS. 1A–1C, only two pairs of diametrically opposed sectors 102 of the cylinder 104 form the punch 100. It is contemplated in accordance with the present invention that the sectored punch 100 could comprise two or more diametrically opposed sector pairs of the cylinder 104 with two pairs of sectors 109 being shown in FIG. 2. When additional pairs of sectors form the punch 100, the sectors become smaller and hence weaker and the use of an alignment pin inserted into the machined bore 108 may become necessary to stabilize and support the punch sectors. Bore 153 is threaded for securing the punch to the press.

In the case of only one diametrically opposed pair of sectors 102, as shown in FIGS. 1A–1C, the apexes of the sectors 102 may be simply drilled or machined away such that two of the punches may be intermated with one another. To permit the spherical retainer to be hand assembled with a truncated spherical member as described in U.S. Pat. No. 4,428,688, the arcuate length of at least one pair of diametrically opposed sectors must be slightly greater than the width of the truncated spherical member to be assembled with the retainer. In most cases, the sectors will all have this arcuate length.

Figure 3:
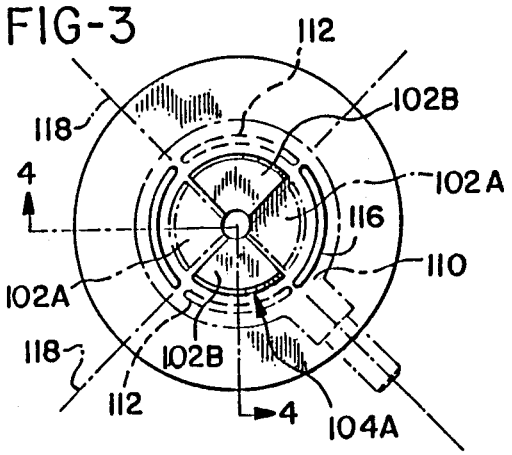
FIG. 3 is a schematic top view of a spherical retainer being formed by a pair of sectored punches coupled with a pair of substantially planar dies.
Figure 4:
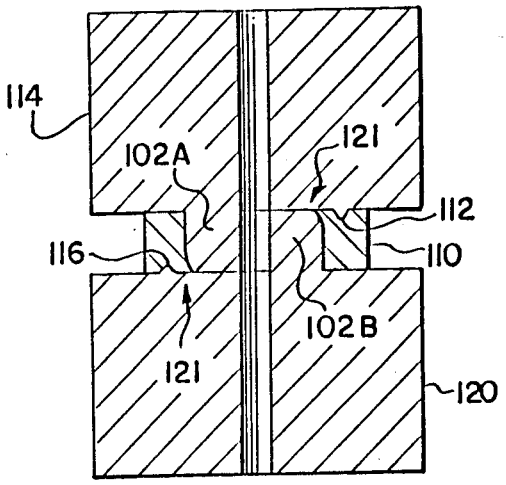
FIG. 4 is a sectional view taken along the line 4—4 of FIG. 3.
Figure 5:
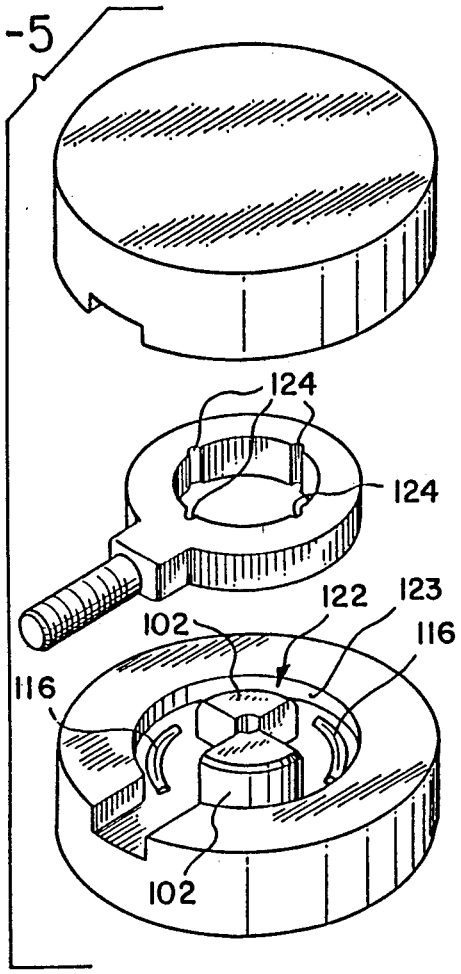
FIG. 5 is a perspective view showing a rod end spherical retainer blank positioned between substantially identical upper and lower stamping tools.

As shown in FIGS. 3–5, a spherical retainer for a tie rod end may be formed utilizing two sectored punches associated with two planar or generally cylindrical dies. FIG. 3 is a schematic illustration of a spherical retainer 110 for a rod end being formed by an upper sectored punch 102A and a lower sectored punch 102B. The rod end blank or ultimately the spherical retainer 110 is shown in dot-dash lines, with the upper punch 102A shown in dotted lines, and the lower punch 102B shown in solid lines to illustrate the interrelationships between the blank and the punches as the spherical retainer 110 is formed.

Impinging segments 112 operate in conjunction with the sectors of the punch 102B, but are associated with the upper sectored punch 102A. The term "impinging" as used herein refers to the segments as means for displacing the metal causing it to flow toward the punch. The impinging segments 112 extend above the surface of a generally planar die 114 from which the punch 102A extends and hence project downwardly as shown in FIG. 4. The segments 112 are positioned outside of the cylinder 104A formed by the intermating sectors of the punches 102A and 102B. Impinging segments 116 operate with the sectors of the punch 102A, but are associated with the lower sectored punch 102B.

The impinging segments 112,116 displace material in the retainer blank toward the spherical distal ends of the sectors of the punches. Preferably, the impinging segments 112,116 are arcuate and extend between the planes 118 defining the sectors of the punches 102A and 102B. As shown in FIGS. 3 and 5, the impinging segments 112,116 associated with the sectored punches are positioned radially beyond the substantially cylindrical surface defined by intermating the sectors of two punches and between the radial faces of the sectors. This configuration places an impinging segment adjacent to the spherically contoured distal end of a punch sector during formation of a spherical retainer such that material displaced by the impinging segment flows into the distal end of the punch sector.

Those skilled in the art should appreciate that other impinging shapes may be used in the present invention provided that they displace the metal in the blank and cause it to flow to and conform with the spherical contour of the punch. Those skilled in the art should also appreciate that, while cold forming processes are illustrated herein, hot forming techniques may be used advantageously in certain applications.

As best seen in FIGS. 3 and 4, the upper tool comprising the substantially planar die 114, the upper sectored punch 102A and the upper impinging segments 112 is placed in face-to-face engagement with a substantially identical lower tool comprising a substantially planar die 120, the lower sectored punch 102B and the lower impinging segments 116 such that the sectors of the punch 102A intermesh with the sectors of the punch 102B. The generally annular blank 110 for a rod end is positioned between the two dies 114 and 120 such that the punches align on a cylindrical opening through the blank 110. As the dies are closed to stamp the blank 110, the sectors of the punches 102A and 102B enter the blank 110 and the metal of the blank is displaced by the impinging segments 112,116 and flows around the spherical contours of the distal ends 106 of the punches 102A and 102B as shown at 121 in FIG. 4 to form the associated spherical portions of a retainer.

In some applications, particularly in forming smaller dimension retainers, it may be desirable to form an open, generally cylindrical die cavity 122 around the sectored punch as shown in FIG. 5. The cylindrical wall 123 functions to contain the metal, thereby preventing it from flowing away from the punch and forcing it to flow toward and to conform to the spherical contour of the punch. Where the retainer is formed from a much larger piece of metal, the tendency for the metal to flow away from the punch is less, and, consequently, the cavity may not be necessary.

It also may be desirable, but is not necessary, to provide notches 124 around the cylindrical opening through the annular blank 110 to provide relief areas for excess metal to flow during the single step stamping operation.

Figure 6:
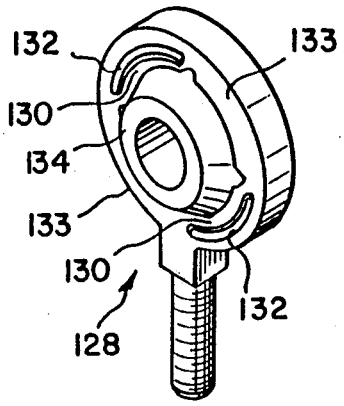
FIG. 6 is a perspective view of a tie rod end bearing formed in accordance with the present invention by the embodiments, shown in FIGS. 3 and 4 or FIG. 5.

A resulting rod end 128, including a spherical retainer, formed in accordance with the method and apparatus of the present invention is shown in FIG. 6. Spherical portions 130 are formed in the outer faces on the opposite sides of the spherical retainer of the rod end 128 by the stamping action of the sectored punches 102A,102B and the associated impinging segments 112,116. Depressions 132 shown in FIG. 6 show where the metal has been displaced by the impinging segments 112,116. Diametrically opposite cylindrical portions 133 permit installation of a truncated spherical bearing 134 as previously described and as is known in the art. Spherical portions 132 can extend any distance around the opening in the retainer provided that the cylindrical portions are sufficiently wide to permit a spherical member to be inserted into the retainer opening on its side, i.e., with its center axis perpendicular to the center axis of the retainer opening, and rotated into a position in which its center axis is coaxial with the center axis of the opening whereby the spherical portions 132 of the retainer engage the spherical outer surface of member 134 and prevent its axial movement. Furthermore, there may be more than one pair of spherical portions 132 and/or cylindrical portions 133 on each side of the retainer provided the spherical member can be assembled with the retainer as described above.

FIG. 7 shows a substantially planar annular blank 140 having a center opening 142, with a plurality of notches 144 extending generally radially outwardly from the opening 142 to form a plurality of lips 146. The notches 144 should be a minimum of 1.5 times the thickness of the blank 140 which is formed, for example, from metal plate. For a given die punch combination, the diameter of the opening 142 determines the depth of the enveloping lips formed from the lips 146. The arcuate length of the lips is a function of the width of the truncated spherical member to be assembled with the retainer. In most instances, all the lips in the retainer will be equal arcuate lengths, slightly larger than the width of the truncated spherical member, however, provided that at least two of the diametrically opposed lip members are long enough to receive the spherical member, the length of the other lip members may vary.

Figure 11:
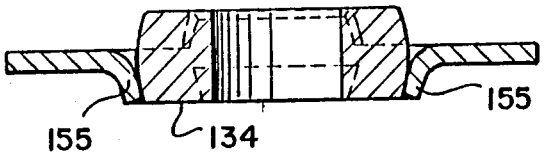
FIG. 11 is a sectional view taken along the line 11—11 of FIG. 10.
Figure 10:
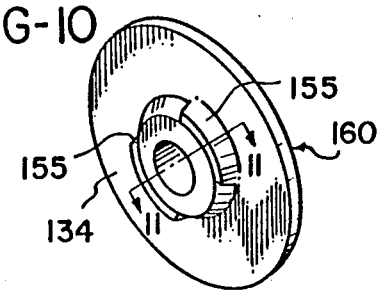
FIG. 10 is a McGregor retainer formed in accordance with the present invention as illustrated in FIGS. 8 and 9 with a bearing inserted therein.

It is noted that the outer contour of the blank 140 is shown as being circular; however, the outer contour may be formed to suit the design of the particular product which is to use the spherical retainer. Further, the spherical retainer formed from the blank shown in FIG. 7 by the apparatus shown in FIGS. 8 and 9 and as shown in FIGS. 10 and 11 is a McGregor retainer which is formed by a single stroke stamping operation in accordance with the present invention.

Figure 9:
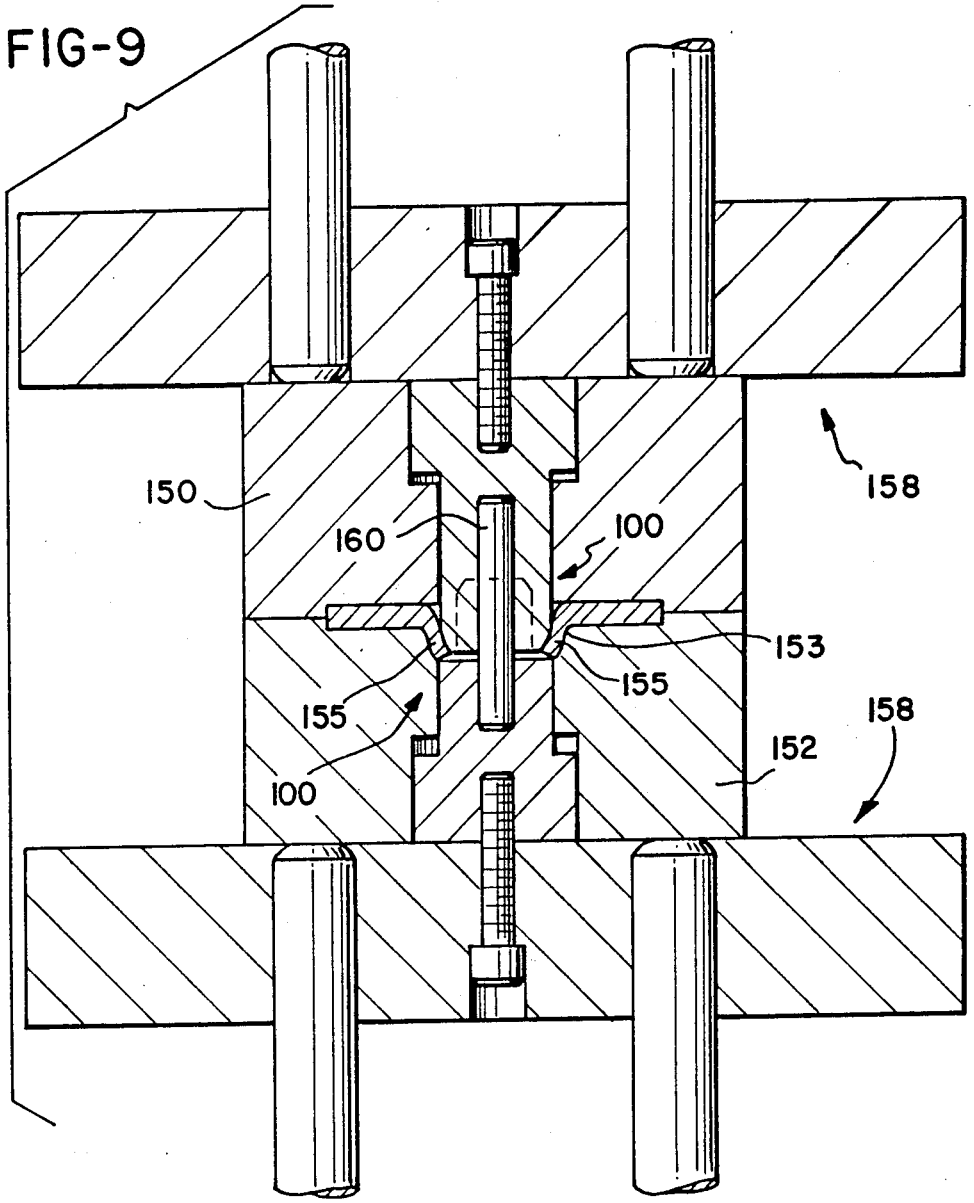

FIGS. 8 and 9 show the formation of a McGregor retainer from the blank 140 shown in FIG. 7 by means of a pair of sectored punches 100 in cooperation with a pair of special dies. In accordance with the present invention, the lips 146 are alternately bent out of the plane of the annular blank 140 by sectored punches 102A, 102B along the area generally indicated by the dotted line 147 in cooperation with dies 150 and 152. Dies 150 and 152 have inwardly tapered surfaces 153. Hereafter, dies 150 and 152 are referred to as frustum dies. The frustum dies 150,152 cooperate with the spherical contours of the distal ends 149 of the sectored punches 100 to form the lips 146 into alternating spherical member enveloping lips. As the lips 146 are formed, the metal therein flows around the spherical surfaces on punches 100 causing the portion of the lip member from which the metal flows around the punch to be slightly thinner than the balance of the retainer.

Two sectored punches 100, as generally shown in FIGS. 1A–1C, are mounted into upper and lower dies 150 and 152 via mounting bores 153. The dies 150 and 152 with the punches 100 secured therein are substantially identical to one another and the dies 150 and 152 include an inwardly tapering frustum portion 154. Dies 150 and 152 float around the punches 100 on pressure pins 157. Dies 150 and 152 are actuated by conventional means such as a hydraulic, spring or air cushion and engage the blank 140 so as to grasp the retainer and maintain it flat during the stamping operation.

The frustum portions 154 of the dies 150,152 cooperate with the spherical contours of the sectored punches 100 to form alternating spherical member enveloping lips 155 from the lips 146. The dies 150 and 152 preferably also contain a blank seating portion 156 which is formed to correspond to the outer contour of the blank 140. As noted previously, with reference to the blanks 140, the blank receiving portions 156 can be circular or whatever contour is appropriate to suit the design of the product which will utilize the McGregor retainer to be formed.

As shown in FIG. 8, the combination punch/die tools for forming a McGregor retainer in accordance with the present invention are shown in the opened position and a pin 160 is inserted into the lower sectored punch 100 for aligning the upper and lower tools and stabilizing the sectors of the punches, particularly when the punches comprise more than one pair of diametrically opposite sectors.

As the tools comprising the dies 150 and 152 and associated sectored punches 100 are brought together as shown in FIG. 9 by the stamping or pressing apparatus 158, the lips 146 of the blank 140 are engaged by the speherical distal ends 149 of the sectors of the punches 100 and forced into engagement with frustum die portions 154 such that the lips 146 are forced about the spherical contours to form spherical retaining surfaces or alternating spherical member enveloping lips 155 from the lips 146. The result of the operations performed by the apparatus of FIGS. 8 and 9 is shown in FIG. 10 wherein a McGregor retainer 160 formed from the blank 140 of FIG. 6 has a truncated spherical bearing 134 inserted thereinto as previously described herein and as is known in the art. The form of the spherical member enveloping lips 155 is further illustrated in the sectional view of FIG. 11 taken along the section line 11—11 of FIG. 10.

In accordance with the above description, a method and apparatus have been disclosed for forming a spherical retainer in a single stroke stamping operation.

Having described the invention in detail and by reference to specific embodiments thereof, it will be apparent that numerous variations and modifications are possible without departing from the scope of the invention. Accordingly, while the methods herein described and the forms of apparatus for carrying these methods into effect constitute preferred embodiments of this invention, it is to be understood that the invention is not limited to these precise methods and forms of apparatus and that changes may be made in either without departing from the scope of the invention which is defined in the appended claims.

What is claimed is:

1. Apparatus for forming a retainer for a truncated spherical member in a single stroke stamping operation comprising:

a sectored punch having at least one pair of diametrically opposed sectors of a cylinder, said sectors being separated from one another such that the sectors of a second sectored punch can be intermated therewith to form a cylinder, the distal ends of said sectors being spherically contoured.

2. Apparatus as claimed in claim 1 further comprising a substantially planar die from which said sectored punch extends and impinging segments extending above the surface of said die and positioned outside of said cylinder between said sectors.

3. Apparatus as claimed in claim 2 wherein said impinging segments are arcuate and extend between said sectors.

4. Apparatus as claimed in claim 1 further comprising a female die, said die having a cavity which is designed to retain said metal blank and prevent the metal forming said blank from flowing away from said punch upon stamping said blank.

5. Apparatus as claimed in claim 4 wherein said cavity is cylindrical.

6. Apparatus as claimed in claim 4 further comprising an alignment pin inserted in said punch.

7. Apparatus as claimed in claim 1 wherein the separation between said sectors comprises a cylindrical bore for slidingly receiving a tool alignment and sector stabilizing pin.

8. Apparatus as claimed in claim 1 further comprising an inwardly tapering frustum die surrounding said punch and wherein said annular blank is planar whereby said frustum die cooperates with the spherical contours of said punch sectors to form alternating spherical member enveloping lips extending out opposite sides of said annular blank.

9. Apparatus as claimed in claim 1 wherein said sectors occupy slightly less than half of said cylinder such that two substantially identical sectored punches can be intermated for stamping an annular blank.

* * * * *